US005236351A

United States Patent [19]

Tien

[11] Patent Number: 5,236,351

[45] Date of Patent: Aug. 17, 1993

[54] SAFETY INTERLOCKS FOR A CIGARETTE LIGHTER

[76] Inventor: Andrew S. H. Tien, 918 W. Beacon St., Alhambra, Calif. 91801

[21] Appl. No.: 3,545

[22] Filed: Jan. 13, 1993

[51] Int. Cl.[5] ..... F23D 11/36

[52] U.S. Cl. ..... 431/277; 431/153

[58] Field of Search ..... 431/277, 153, 255; 222/153

[56] References Cited

U.S. PATENT DOCUMENTS

| | | | |
|---|---|---|---|
| 4,717,335 | 1/1988 | Loveless | 431/277 |
| 4,799,877 | 1/1989 | Bisbee | 431/153 |
| 4,822,276 | 4/1989 | Bisbee | 431/153 |
| 5,066,220 | 11/1991 | Vick | 431/277 |
| 5,074,781 | 12/1991 | Fujita | 431/153 |
| 5,076,783 | 12/1991 | Fremund | 431/153 |
| 5,085,578 | 2/1992 | Hunter | 431/153 X |
| 5,096,414 | 3/1992 | Zellweger | 431/277 |
| 5,104,313 | 4/1992 | Zellweger | 431/153 X |
| 5,184,948 | 2/1993 | Iwahori | 431/153 |

*Primary Examiner*—Carl D. Price

[57] ABSTRACT

A cigarette lighter is disclosed having a spark producing wheel, a fuel delivery valve, and a fuel supply tank, all of which are mounted in a case and cooperate with a novel safety interlocking means. The interlock means includes a wheel interlock tooth for locking and unlocking the friction wheel which is actuated by a spring type handle mounted on one side face of the case. The wheel interlock tooth is attached to a coupling means which must be in an advanced position to allow the actuation of the fuel valve lever so that neither the fuel flow nor the spark may be activated unless the safety handle leaf spring is depressed.

3 Claims, 2 Drawing Sheets

SAFETY INTERLOCKS FOR A CIGARETTE LIGHTER

FIELD OF THE INVENTION

This invention relates generally to cigarette lighters, and, more particularly, is directed towards a cigarette lighter with improved safety means.

BACKGROUND OF THE INVENTION

A cigarette lighter in a child's possession is potentially quite dangerous, and therefore it is not surprising to see several prior art devices that address such a hazard. For example, U.S. Pat. No. 4,717,335 to Loveless on Jan. 5, 1988, illustrates a child resistant lighter that limits the rotation of a spark producing wheel unless a small lever is actuated first. However, such a device still permits a fuel valve to be actuated, which may still result in fuel ignition from another source. U.S. Pat. No. 5,076,783 to Fremund on Dec. 31, 1991, teaches a safety lighter that restricts the movement of a fuel valve actuator lever unless a safety latch at the bottom of the lighter is previously actuated. However, such a device still allows the spark producing wheel to produce sparks, which may result in ignition of some flammable substance other than the lighter's fuel.

Typically, prior art safety lighters either restrict the rotation of the spark producing wheel or restrict the actuation of the fuel valve, but not both. As a result, undesirable ignition of flammable substances may still occur with such devices. Moreover, many children will quickly discover how to overcome, the single safety features of the prior art devices. However, if there were more than one such safety features incorporated into a single safety lighter, many children would become bored with trying to operate the lighter and cease trying.

Another prior art safety lighter device, disclosed in U.S. Pat. No. 4,799,877, limits the use of the lighter unless the lighter is partially pulled from a restrictive housings. However, if a persón using such a device forget to return the lighter to its fully inserted position into the housing, the valve restricting means will not operate. As a result, a child may freely use such a lighter.

Clearly, then, there is a need for a safety lighter that both limits the rotation of the spark producing wheel and limits the fuel valve actuation lever. Such a needed device would automatically reset itself after use, such that the user would not need to remember to manually lock or restrict the lighter mechanisms. The present invention fulfills these needs and provides further related advantages.

Another design for a lighter having safety interlocking means is described in a co-filed U.S. patent application. This other design provides certain safety advantages including a first safety assembly for controlling the fuel delivery valve including a pair of adjacent, concentrically aligned rings providing engagement notches therein for accepting engagement by an elongated portion of the fuel delivery valve actuator. The engagement of the elongated portion with the aligned engagement notches allows the valve actuator to be depressed, whereby fuel flows from the fuel supply tank through the fuel delivery valve. At least one of the rings is rotatable such that the two engagement notches, when manually released, become nonaligned, thereby preventing fuel from flowing from the fuel supply tank through the fuel delivery valve. A second safety assembly controls the production of the spark and provides a toothed wheel for rotating with the spark producing wheel. A tongue is held by the case in a position for engaging the toothed wheel such that the wheel is prevented from rotating so that the spark producing capability of the spark producing wheel is disabled. A spring is further included for providing engagement force for normally holding the toothed wheel against the tongue. The toothed wheel is mounted onto an axle supported in a pair of elongated holes, such that the toothed wheel may move into and out of engagement with the tongue. One drawback of my other design is that the friction wheel may be turned by a child after some experimentation, and indeed the same is true of the interlock on the fuel valve mechanism.

The present invention both limits the rotation of the spark producing wheel and limits the fuel delivery means in a manner that may be constructed to require an adult sized hand since two levers must be actuated together and in sequence. Further, the present invention automatically resets itself after use, such that the user does not need to remember to manually lock or restrict the lighter mechanisms after each use. Other features and advantages of the present invention will become apparent from the following more detailed description, taken in conjunction with the accompanying drawings, which illustrate, by way of example, the principles of the invention.

SUMMARY OF THE INVENTION

The present invention is a cigarette lighter having a generally conventional spark producing means, fuel delivery means, and fuel supply tank, all of which are mounted in a case and cooperate with a novel safety interlocking means. The case supports a fuel storage means for liquid or gaseous lighter fuels, a spark producing means providing a friction wheel in contact with a spark generating stone for producing sparks when the friction wheel turns, a fuel delivery means providing a fuel valve, a valve actuation lever, and a fuel nozzle, arranged so that movement of the valve actuation lever opens the fuel valve to admit fuel from the fuel storage means to the fuel nozzle. The interlock means includes a wheel interlock tooth for locking the friction wheel which is actuated by a spring type handle mounted on one side face of the case. The wheel interlock tooth must be in an advanced position to allow the actuation of the fuel valve lever so that neither the fuel flow nor the spark may be activated unless the safety handle leaf spring is depressed. The invention achieves the result of preventing the turning of the friction wheel and of the depressing of the fuel valve lever unless the safety handle is depressed first. This provides a significant improvement in safety of the lighter when in the hands of a child. Further, the present invention automatically resets itself after use, such that the user does not need to remember to manually lock or restrict the lighter mechanisms after each use. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 2:
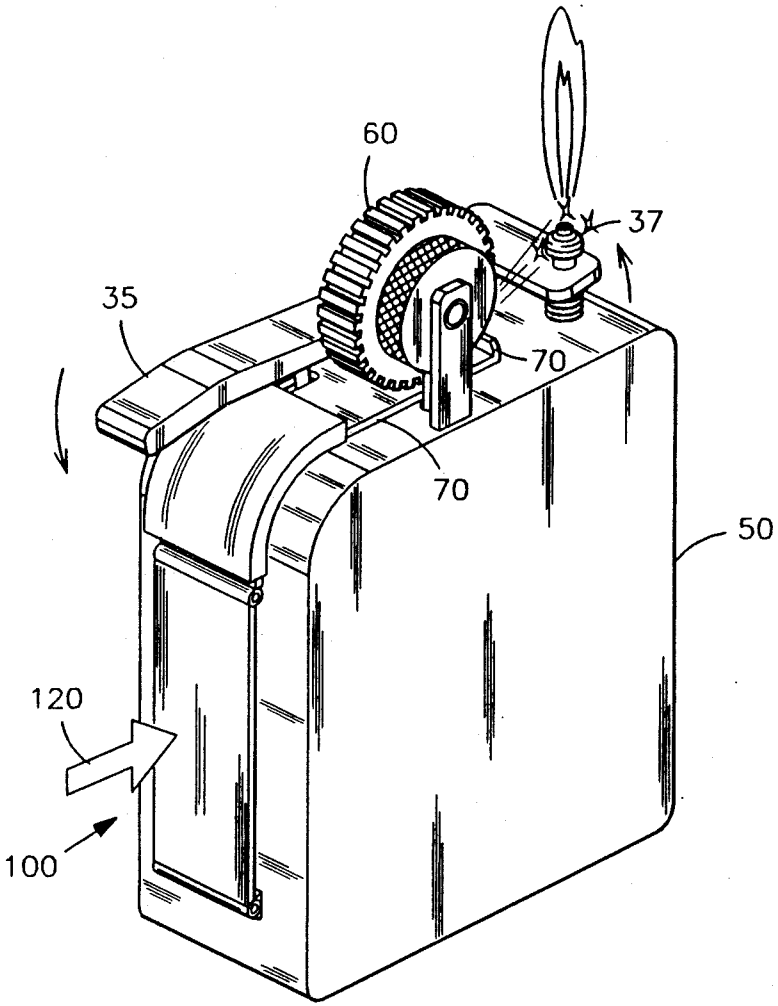
FIG. 2 is a perspective illustration of the invention, illustrating a cigarette lighter having a safety mechanism showing the mechanism in the activated state.
Figure 1:
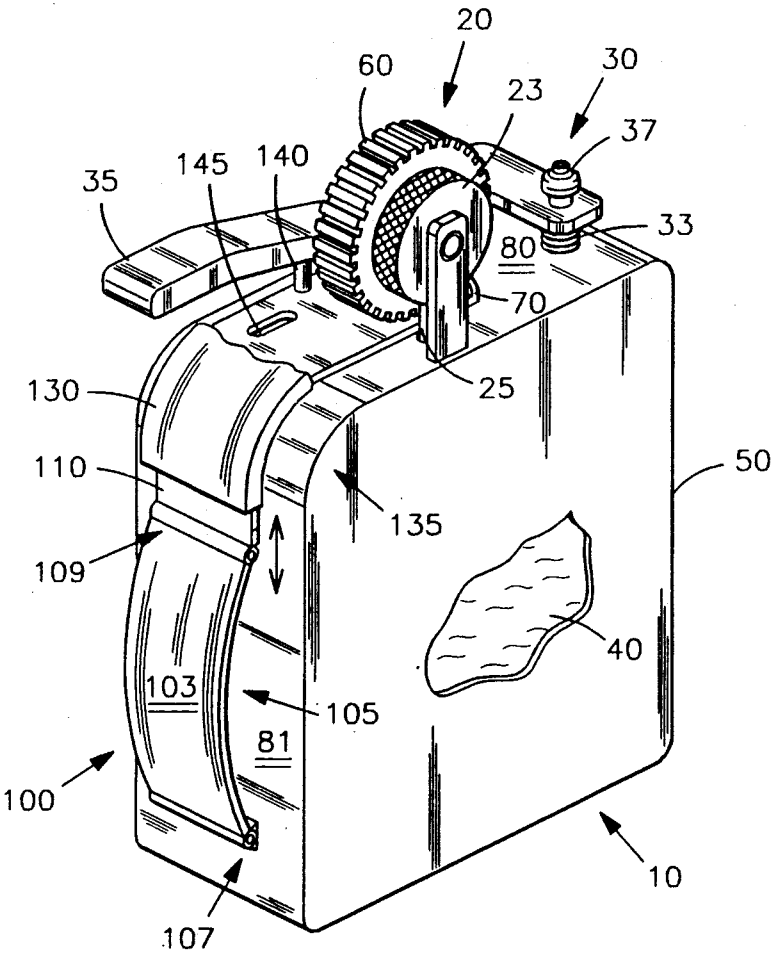
FIG. 1 is a perspective illustration of the invention, illustrating a cigarette lighter having a safety mechanism showing the mechanism in the relaxed or non-activated state.
Figure 3:
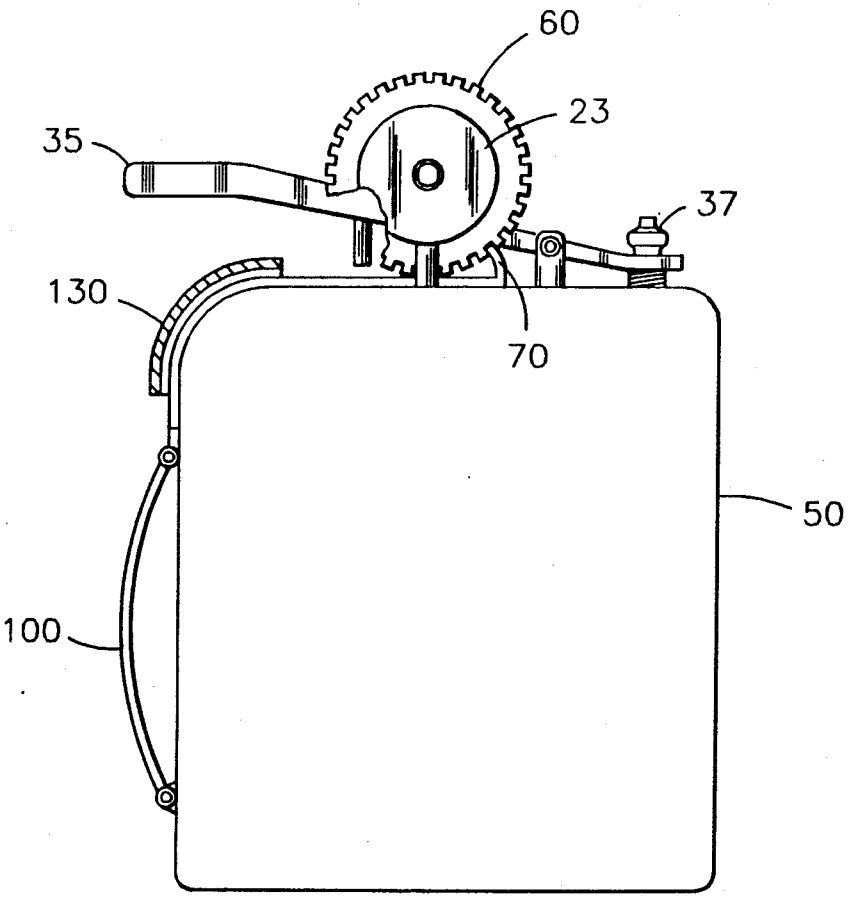
FIG. 3 is a left-side elevational view of the invention with obvious portions removed or cutaway for clarity.

FIG. 1 shows a cigarette lighter 10 having a case means 50 for supporting a fuel storage means 40, a spark producing means 20 providing a friction wheel 23 in contact with a spark generating stone 25 for producing sparks when the friction wheel 23 turns. A fuel delivery means 30 provides a fuel valve 33, which is a common part known to the art, a valve actuation lever 35, and a fuel nozzle 37, arranged so that movement of the valve actuation lever 35 opens the fuel valve 33 to admit fuel from the fuel storage means 40 to the fuel nozzle 37. These functions are well known in the art.

The safety improvements to the lighter include a toothed drive wheel 60 mounted to the friction wheel 23 which shares a common axle 63 with it so that the friction wheel 23 and drive wheel 60 rotate together. Also included in the improvements is a wheel interlock tooth 70 in sliding contact with a first face 80 of the case means and which is normally in engagement with the toothed drive wheel 60, such that as the wheel interlock tooth 70 is caused to slide along the first face 80, it imparts rotation to the drive wheel 60, the friction wheel 23 moving therewith to cause spark generation against stone 25.

A leaf spring 100 provides a normally convex surface 103 on one side, facing away from the case means 50, and a normally concave surface 105 on the corresponding alternate side thereof. These sides lay between a first end 107 of the spring 100, this end being fixed to a second face 81 of the case means 50, and a second end 109 of the spring 100, being in sliding contact relation with a second face 81 of case means 50, such that a lateral force 120 for urging the spring 100 toward the case means 50 causes the second end 109 to linearly translate on the second face 81 away from the first end 107.

A coupling means 110 for connecting the second end 109 of the spring 100 to the wheel interlock tooth 70, such that linear translation of the second end 109 of the spring 100 causes the wheel interlock tooth 70 to execute the sliding motion along the first face 80.

The coupling means 110 may be a flexible plate having spring temper, and further may include a guide sheath 130 fixed to one corner 135 of the case means 50 for guiding the coupling means 100 around the one corner 135 in transferring the motion of the second end 109 of the spring 100 to the wheel interlock tooth 70. If the spring 100 and the tooth 70 are on the same face of the case means 50 then the sheath 130 may not be necessary depending on the tendency of the coupling means to buckling under compressive forces.

A further interlock means for the actuation lever, comprising an engagement finger 140 extending from the actuation lever 35 toward the coupling means 110, and including a clearance slot 145 in the coupling means 110 for receiving the engagement finger 140 only when the coupling means 110 is moved from an initial rest position by depressing the leaf spring 100 is employed to provide for fuel valve safety. In this case the engagement finger 140 and the clearance slot 145 are not aligned until the leaf spring 100 is depressed, thereby preventing the actuation lever 35 from causing fuel to flow from the fuel nozzle 37 unless the leaf spring 100 is depressed.

In operation, pressure downward on the actuation lever 35 with simultaneous pressure on the spring 100 results in pushing the tooth 70 out of engagement with the toothed drive wheel and also provides alignment of the engagement finger 140 with the clearance slot 145 in the coupling means 110 so that the actuation lever 35 may be fully depressed thereby releasing fuel valve 33. In a child's hands, the invention may provide significant safety in that the child cannot turn the friction wheel 23 by direct contact thereon, and he cannot release the fuel valve 37 by direct pressure onto the actuation lever 35. If the spring is built with resistance requiring the force of an adult hand to depress it, then it could be nearly impossible for the child to either release the fuel or cause sparks to be ejected from the unit.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. Safety interlock means for a cigarette lighter having a case means for supporting a fuel storage means, a spark producing means providing a friction wheel in contact with a spark generating stone for producing sparks when the friction wheel turns, a fuel delivery means providing a fuel valve, a valve actuation lever, and a fuel nozzle, arranged so that movement of the valve actuation lever opens the fuel valve to admit fuel from the fuel storage means to the fuel nozzle, the interlock means including:

a toothed drive wheel mounted to the friction wheel and sharing a common axle therewith so that the friction and drive wheels rotate together, a wheel interlock tooth in sliding contact with a first face of the case means and providing locking and unlocking of the toothed drive wheel, such that as the wheel interlock tooth is caused to slide along said first face, the wheel interlock tooth moves out of engagement with the drive wheel, the friction wheel moving therewith to cause spark generation;

a leaf spring providing a normally convex surface on one side, facing away from the case means, and a normally concave surface on the corresponding alternate side thereof, said sides lying between one end of the spring, said end being fixed to a second face of the case means, and a second end of the spring, said second end being in sliding contact relation with the second face, such that a lateral force for urging the convex surface toward the case means causes the second end to linearly translate on the second face of the case means away from the first end;

a coupling means for connecting the second end of the spring to the wheel interlock tooth such that linear translation of the second end of the spring causes said wheel interlock tooth to execute said sliding motion along said first face thereby decoupling from the drive wheel such that the drive wheel may be manually turned.

2. The safety interlock of claim 1 wherein the coupling means is a flexible plate having spring temper, and further including a guide sheath fixed to one corner of the case means for guiding the flexible plate around said one corner in transferring the motion of the second end of the spring to the wheel interlock tooth.

3. The safety interlock of claim 2 further including a safety interlock means for the actuation lever, comprising an engagement finger extending outwardly from the actuation lever toward the coupling means, and including a clearance hole in the coupling means for receiving the engagement finger only when the coupling means is moved from an initial rest position by depressing the leaf spring, such that the engagement finger and clearance hole are not aligned until said leaf spring is depressed thereby preventing the actuation lever from causing fuel to flow from the fuel nozzle unless the leaf spring is depressed.

* * * * *